US005500835A

United States Patent [19]

Born

[11] Patent Number: 5,500,835

[45] Date of Patent: Mar. 19, 1996

[54] WEATHER FORECASTING WATCH

[75] Inventor: Jean-Jacques Born, Morges, Switzerland

[73] Assignee: Asulab S.A., Bienne, Switzerland

[21] Appl. No.: 390,547

[22] Filed: Feb. 17, 1995

[30] Foreign Application Priority Data

Mar. 4, 1994 [CH] Switzerland ..... 00643/94

[51] Int. Cl.[6] ..... G04B 47/06

[52] U.S. Cl. ..... 368/11

[58] Field of Search ..... 368/11

[56] References Cited

U.S. PATENT DOCUMENTS

| | | | |
|---|---|---|---|
| 2,510,402 | 6/1950 | Johnston | 368/11 |
| 2,716,327 | 8/1955 | Franklin et al. | 368/11 |
| 2,763,122 | 9/1956 | Hayes | 368/11 |
| 3,315,462 | 4/1967 | Bosquet | 368/11 |
| 4,257,112 | 3/1981 | Hubner | 368/11 |
| 4,266,288 | 5/1981 | Berney | 368/28 |
| 4,279,028 | 7/1981 | Lowdenslager et al. | 368/11 |

FOREIGN PATENT DOCUMENTS

| | | |
|---|---|---|
| 0099330 | 1/1984 | European Pat. Off. . |
| 0345929 | 12/1989 | European Pat. Off. . |
| 2711343 | 9/1978 | Germany . |
| 3603073 | 8/1986 | Germany . |
| 374337 | 9/1963 | Switzerland . |

OTHER PUBLICATIONS

Patent Abstract of Japan vol. 6, No. 233 (P–156) (1111) 19 Nov. 1982 & JP–A–57 135 386 (Citizen Tokei K.K.) 20 Aug. 1982.

Patent Abstracts of Japan vol. 10, No. 127 (P–455) 13 May 1986 & JP–A–60 252 292 (Suwa Seikosha K.K.) 12 Dec. 1985.

Patent Abstracts of Japan vol. 14, No. 574 (P–1145) 20 Dec. 1990 & JP–A–02 247 594 (Kemikarainjingu Kenkyusho K.K.) 3 Oct. 1990.

*Primary Examiner*—Bernard Roskoski

*Attorney, Agent, or Firm*—Griffin, Butler, Whisenhunt & Kurtossy

[57] ABSTRACT

An analogue timepiece capable of indicting a pressure variation, such as that of atmospheric pressure, comprises at least two hands (2, 3) for providing time information, a watch movement (12) for driving the hands and a pressure sensor (13, 13*a*) for measuring the atmospheric pressure variation. One of the hands (2, 3) indicates the measured pressure variation while one of the others of said hands (3, 3) indicates at the same time a weather forecast as a function of the variation.

7 Claims, 4 Drawing Sheets

WEATHER FORECASTING WATCH

BACKGROUND OF THE INVENTION

The present invention concerns a timepiece and in particular a watch comprising a pressure sensor capable of indicating any variation in the atmospheric pressure.

The document EP-A-0 345 929 describes a multimode watch comprising such a sensor. This watch further comprises a first analogue display indicating the time and a second digital liquid crystal display capable of indicating the measured atmospheric pressure. Also, this second display may indicate the variation of the pressure between two consecutive measurements. However, this indication is done by way of an arrow which only indicates if the pressure has increased (arrow indicating upwards), if the pressure has decreased (arrow indicating downwards) or if the pressure hasn't changed (the two arrows at the same time). This arrangement doesn't give any forecast of the meteorological weather. Furthermore, the reading and the aesthetics of such a watch indicating at the same time several items of information on several displays does not seem optimal.

American Patent U.S. Pat. No. 4 257 112 describes a timepiece, a watch, which comprises a sensor for reacting to the atmospheric pressure and which provides its wearer with a barometric indication. A system of arrows is here too used to display the barometric tendency on a liquid crystal digital display device. This system indicates five different tendency conditions and is thus more extensive than the indication system of the European document mentioned above, but the indications are still not of an optimal clarity. Furthermore, this watch does not give any indication relative to a weather forecast.

SUMMARY

According to principles of this invention an analogue timepiece capable of indicating any variations of the atmospheric pressure comprises at least two hands capable of providing a time information, a timepiece movement for driving the hands and a pressure sensor for measuring the variation of the atmospheric pressure; the timepiece being characterized in that one of the hands may indicated the variation of the measured pressure while at the same time another of the hands may indicate a weather forecast as a function of the variation.

Advantageously, the weather forecast may be calibrated so that this indication may correspond to the weather as observed, that is to say that the wearer of such a timepiece may correct the indication of the forecast if this forecast doesn't seem correct to him.

BRIEF DESCRIPTION OF THE DRAWING

The invention will be described hereinafter, by way of a non-limitative example with reference to the drawings in which.

DESCRIPTION OF THE PREFERRED EMBODIMENT

Figure 1:
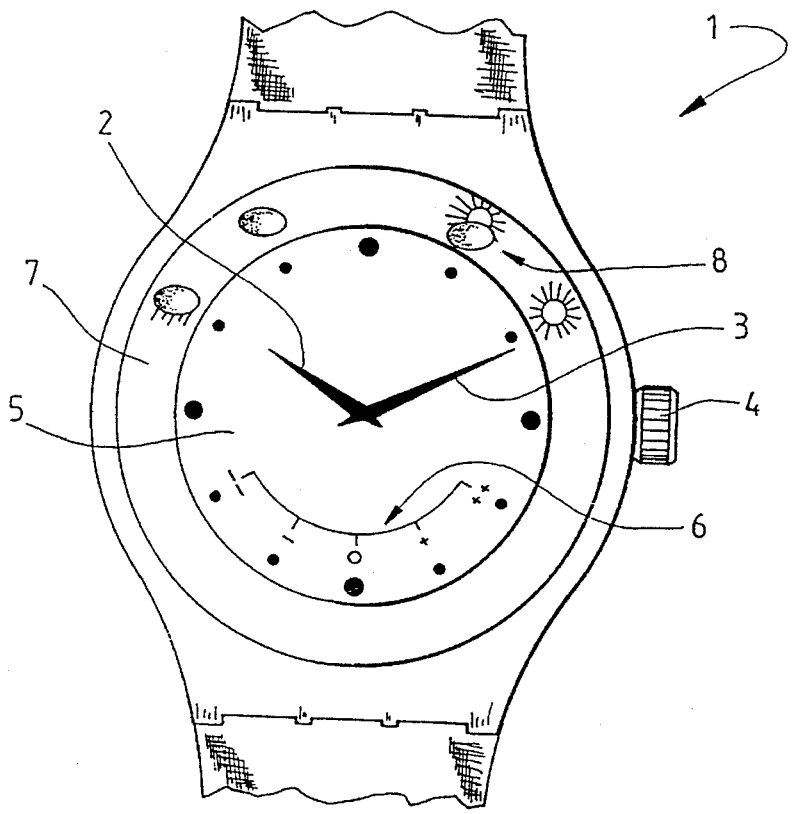
FIG. 1 is a schematic top view of a watch according to this invention in a classical display mode of time.
Figure 5:
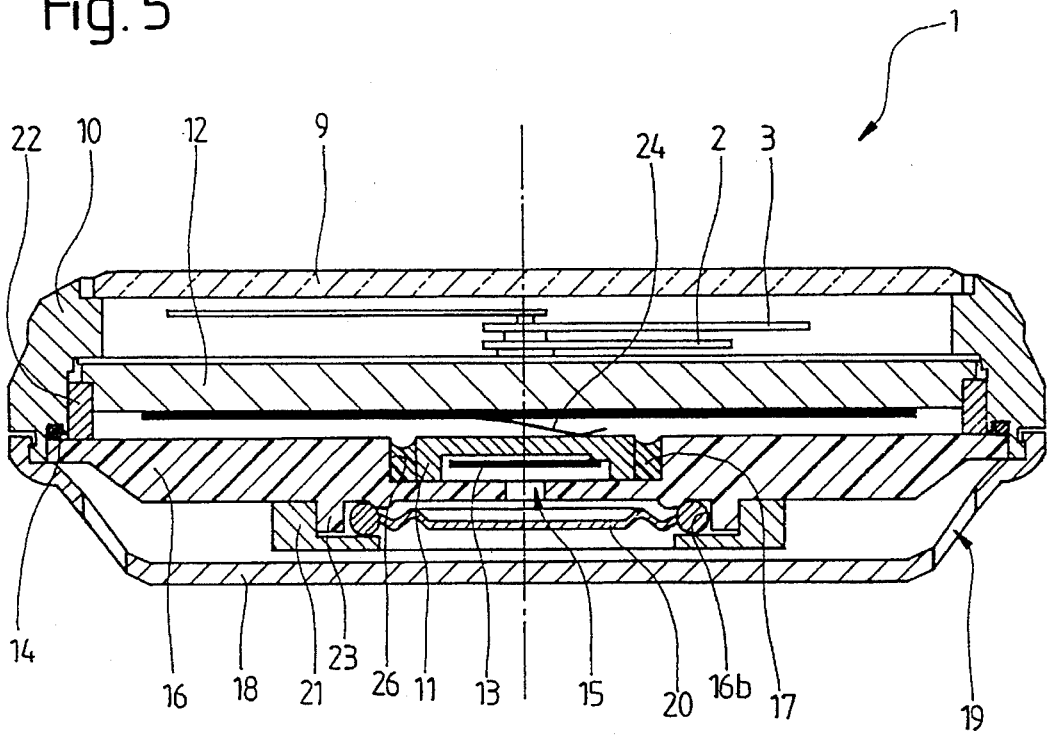
FIG. 5 is a cross-sectional view of a watch according to this invention corresponding to a first embodiment.

FIG. 1 represents schematically a timepiece according to the invention. Timepiece 1, which in the example represented is a wrist-watch, comprises an analogue display of the time formed by an hour-hand 2 and a minute-hand 3. Of course, watch i may further comprise other hands, for example a second hand (not shown). This analogue display is not limited to providing the time itself but may also provide other time information such as the date, the day, the month, the year, etc. Watch 1 further comprises a watch movement 12 of a classic construction (FIGS. 5 and 6) linked to a crown 4 (FIG. 1), by way of a not-shown shaft. By manipulating the crown 4 the displayed time may be adjusted. This may be done in a classical way by pulling the crown 4 outwardly, which thereby manipulates the shaft, and then by turning the crown/shaft set. A dial 5 of the watch 1 not only comprises several indicia of ordinary watches, such as, for example, hour markings, minute and/or second markings, or the like, but it also comprises a display 6 for indicating variations in pressure, here the atmospheric pressure. Watch 1 comprises a bezel 7 which is attached to the middle of the watch in a known manner, and on which may be displayed several indication of the weather. The bezel may be attached in a fixed or a movable manner as will be explained hereinafter.

Construction of the watch according to the invention will be described hereinafter corresponding to a first embodiment. In this first embodiment, represented in FIG. 5, the watch 1 comprises a pressure sensor, which is here a quartz sensor 13.

The principle of a quartz sensor such as is used here is known from European patent EP-B-0 099 330. This patent describes a pressure measuring sensor using an element sensitive to the pressure. This sensitive element comprises a tuning-fork made of piezoelectric material, for example quartz, which delivers pressure information by way of a frequency. The tuning-fork is provided with electrodes for vibrating its arms. In fact, in the case that such a tuning-fork is excited by way of deflection, that is to say when its arms vibrate, the variation of the inherent-frequency (resonant frequency) of the resonator is a function of the pressure. Thus, the frequency of the resonator varies as a function of atmospheric pressure if the resonator is exposed to surrounding air.

It is therefore possible to use this phenomenon to obtain an indication of the barometric situation.

Watch 1 comprises, in a known manner, a watch glass 9 attached to a watch-case middle 10 of watch 1 to protect the hands 2 and 3 and the dial 5. The middle 10 thus supports the glass 9 and its bezel and a back cover 18, which protects the movement 12 of the watch. The movement 12 is placed in a fitting ring 22 which is itself placed on an internal back cover 16. In fact, the backcover of the watch, according to the invention, consists of a double back, i.e. the first internal back cover 16 which is bedded in and held by the middle 10 and the second external pierced back cover 18, which is attached to an exterior of the middle. A water-resistant gasket 14 is placed between the first internal back cover 16 and the middle 10. The second external back cover 18 is pierced so as to allow the surrounding air which is to be measured to pass through several small passages 19. In the top surface of the first internal backcover 16 a bed 26 is provided in which the quartz pressure sensor 13 is placed together with its casing 11 (corresponding to a sensor's casing described in the patent EP-B-0 099 330). Preferably, the casing is held in place and protected by an epoxy resin 17.

The sensor 13 comprises devices (not shown) for vibrating its arms and for registering the inherent-frequency of the tuning-fork under the influence of the surrounding air pressure. The sensor 13 further comprises devices (not shown) to convert variations of the frequency into a pressure indication, as was explained with reference to European patent EP-B-0 099 330. These conversion devices also convert the pressure variations into a weather forecast as was mentioned above.

The conversion devices are thus electrically connected to an electronic control mechanism of the movement, for example by way of a contact 24, so as to drive the hands of the watch 1 correspondingly to indicate variations of atmospheric pressure as well as weather forecasts corresponding to these variations.

The internal back cover 16 is provided in its lower surface with an opening 15 placed below the pressure sensor 13 to allow penetration of the surrounding air received from outside the casing by way of the external backcover 18.

The sensor is sensitive to the molecular mass of the gas to be measured, here this gas thus being the surrounding air. To ensure an invariable molecular mass of the gas, a variable volume chamber is created by the casing 11 of the pressure sensor 13, by the opening 15 in the back cover 16 and by a membrane gasket 20. This volume encloses a gas whose pressure is identical to a surrounding external pressure because of the mobility of membrane gasket 20. In the case of an over-pressure, for example when the wearer of the watch of this invention goes deep diving in water, membrane gasket 20 will push against the internal backcover 16 around the opening 15 thus avoiding deterioration of the membrane gasket 20. A bed **16*b* is placed lower than the bottom surface of the first backcover 16 and is formed by a circular flange 23 which extends towards the external backcover 18. A membrane support 21 is fixed to the flange 23**.

Figure 6:
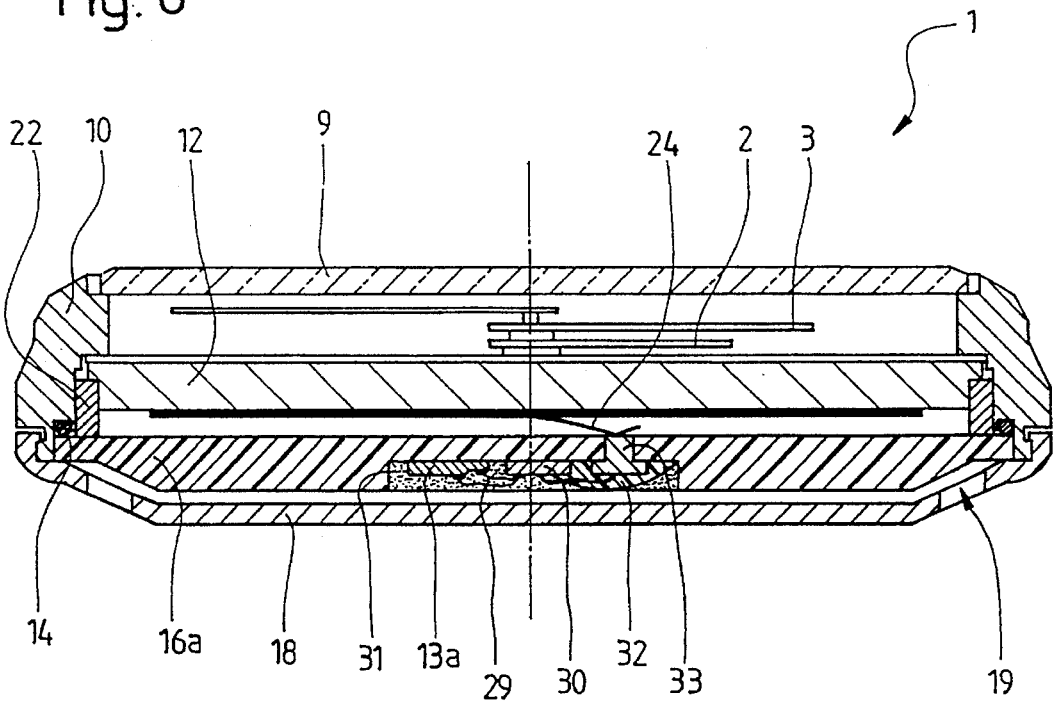
FIG. 6 is a cross-sectional view of a watch according to this invention corresponding to a second embodiment.

Reference will now be made to FIG. 6 which represents a second embodiment of a watch according to the invention. As can be seen, this watch is of a construction analogous to that of the first embodiment except for the pressure sensor and the internal first backcover 16 holding it.

In the second embodiment, the pressure sensor is either a capacitive sensor, or a piezoresistive sensor. The functioning of such sensors is well known to those skilled in the art, and it is not described here in detail.

As the construction for these two sensors is otherwise identical, only the portion comprising the capacitive sensor will be described hereinafter.

The capacitive sensor is referenced in FIG. 6 by reference numeral **13*a* and is formed of two electrodes delimiting a dielectric volume. The first electrode is formed of a flexible plate allowing the external pressure to vary a dielectric volume, and thus a capacity, and the second electrode is of a classic construction. With this type of sensor, it is possible to have a direct contact with the surrounding air. It is therefore possible to have an internal first backcover 16*a* which is not as thick as the backcover 16 of the first embodiment because the membrane gasket may be omitted. Here it is sufficient to attach the sensor to the first backcover 16*a* and to surround it with a material 31, for example silicon gel, to ensure water resistance. Both electrodes are connected by way of connection wires 29 to conversion apparatus 30 to convert the received information (analogue) into useful information (digital), these apparatus being comparable to the conversion devices of the quartz sensor. These apparatus 30 may consist of an integrated circuit which is, preferably, placed as close as possible to the sensor so that the connection wires will be kept very short. Thus, capacitive influences of the wires will be avoided which is important in case the information signal is very weak. To protect the connection wires in the conversion apparatus 30, so as to ensure water resistance, its arrangement may be surrounded by a material such as the gel 31**.

Conversion apparatus 30 are then electrically connected to the movement 12, for example by way of connection wires connected to a contact stud 33, which is surrounded by a protecting resin 32 (for example an epoxy resin), and a contact strip 24, analogous to the contact of the first embodiment described above, which is attached to the movement 12 and rests on the contact stud 33.

The function of the watch is the following.

Figure 2:
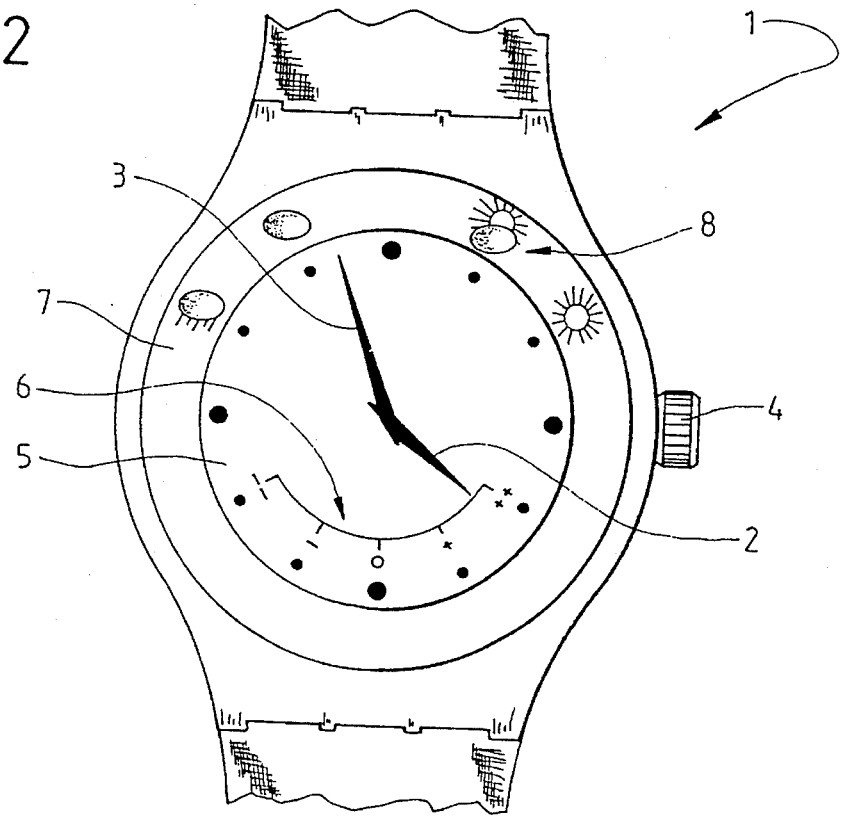
FIG. 2 is a schematic top view of a watch according to the invention while it is indicating variations of pressure and a corresponding weather forecast.

As can be seen in FIG. 2, when the crown 4 is pushed, one hand, in this example the hour hand 2, indicates together with the display 6 pressure variations measured by the pressure sensor 13, **13*a*. At the same time, another hand, in this example the minute hand 3, indicates the meteorological weather forecast for the day in progression as a function of the measured variation of this pressure. In another embodiment, the hour hand 2 may indicate conversely the weather forecast as a function of the variation of the pressure which may itself be indicated by the minute hand 3; one of these indications may of course in another embodiment be indicated by the second hand (not represented in FIGS. 1 and 2**), or even by a supplementary hand.

As can be seen in FIGS. 1 and 2, the display 6 which indicates the pressure variation comprises five different levels of the tendency of the barometric pressure, i.e. a first for a large drop in pressure (—), a second for a small drop (–), a third for a stable pressure (0), a forth for a small rise (+) and a fifth for a strong rise (++). As a function of the atmospheric pressure variation which is measured by the pressure sensor 13, **13*a*, which is itself activated by movement 12, to which the pressure variation information has been provided, a hand forming the indicator of this variation (here the hour hand) will position itself at the corresponding marking of display 6 on the dial. The other hand, here the minute hand 3, forming the weather indicator, will receive forecasting information from the conversion apparatus 30 and will indicate together with the forecast display 8 the meteorological forecast which corresponds best to the measured pressure variation. In this example, the display 8 of the weather forecast comprises four different forecasts, represented symbolically to indicate rain, cloudy sky, partly sunny and sunshine. Inasmuch as the hands provide an indication over an analogue range, they may also indicate intermediate conditions; thus, not only several fixed conditions are provided, but complete ranges in between these conditions. Display 8 is placed in this example on bezel 7** having several indications of the weather forecast. In general, a large increase of the pressure (indicated by "++" on the dial) corresponds to an improvement of the weather, a large drop (indicated by "— ") corresponds to a deterioration of the weather, and a stable pressure (indicated by "0") corresponds to a situation where the weather doesn't change. As will be understood, the weather forecast display may be placed on the dial instead of being placed on the bezel.

However, if the wearer of watch 1 according to the invention changes his place such that this change of position will influence the measurement—for example if, between two consecutive measurements, the place or the elevation where the wearer is present changes significantly—the weather forecast will no longer be correct.

Figure 3A:
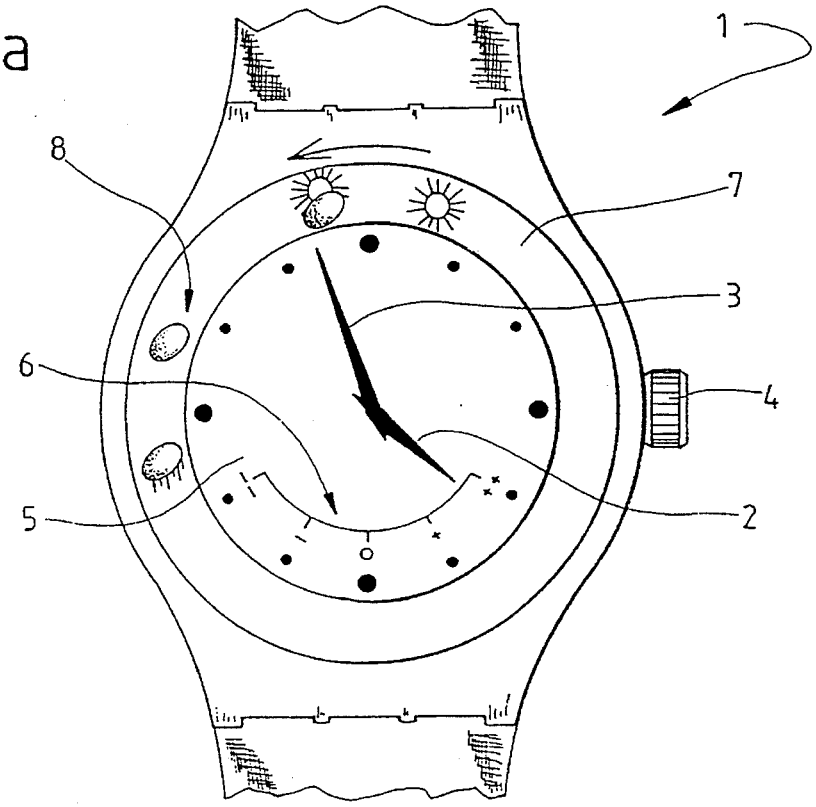
FIG. 3*a* is a view similar to FIG. 2, but schematically representing a first possibility of correcting an indication of the weather forecast.
Figure 3B:
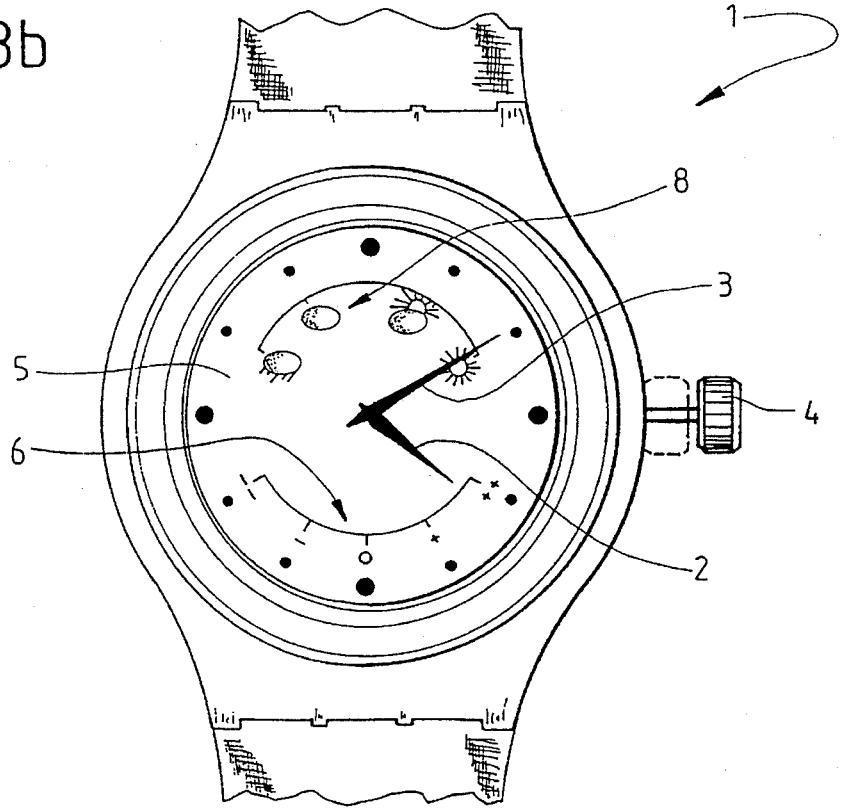
FIG. 3*b* is a view similar to FIG. 2, but schematically representing a second possibility of correcting such indication of the weather forecast.

It is therefore desirable that the wearer be able to correct this forecast so that it corresponds to the actual observed weather conditions for the passing day. This is made possible in a first example (see FIG. 3*a*) by the fact that the bezel 7 is mounted in a movable manner on the middle of the watch case. Thus, the wearer may correct the forecast indication by turning the bezel 7 which comprises display 8 of the weather forecast until the hand indicates the forecast which is assumed to be correct. FIG. 3*b* shows a second embodiment allowing such a correction. Here, the bezel 7 is mounted in a fixed manner on the middle, and display 8 of the weather forecast is placed on dial 5. The wearer may move the indicator, that is the hand itself, display 8 being fixed, to a position he assumes is correct. As will be understood, this displacement may be carried out by turning the crown 4 while the watch is indicating the pressure variation, in the same manner is a correction of the position of the hand indicating the time of day is carried out. Thus the wearer may calibrate the watch 1 as well as his pressure sensor at any time and he may thus obtain a total independence of the indications relative to the place where he is.

The display is, as already mentioned, analogue and is driven by, for example, a bidirectional step motor engaging the hands. It may also comprise two motors which drive, in the embodiment represented, respectively the minute hand 3 and the hour hand 2. In the case of only one motor, a clutch will of course be necessary to break a kinematic relation between the two hands at least during the measurement displaying phase. Such an arrangement is known to skilled persons and will not be explained in detail here.

The measured pressure variation will thus provide the activation of several steps of the motor driving the hand indicating this variation. The weather forecast is a function of this pressure variation and is defined by the formula $K.\Delta p$. Thus, the other hand, which indicates the weather forecast, here hand 3, will be driven a certain number of steps N by the motor which corresponds to $K.\Delta p$, K being a constant determined experimentally, and $\Delta p$ being the measured variation.

Figure 4:
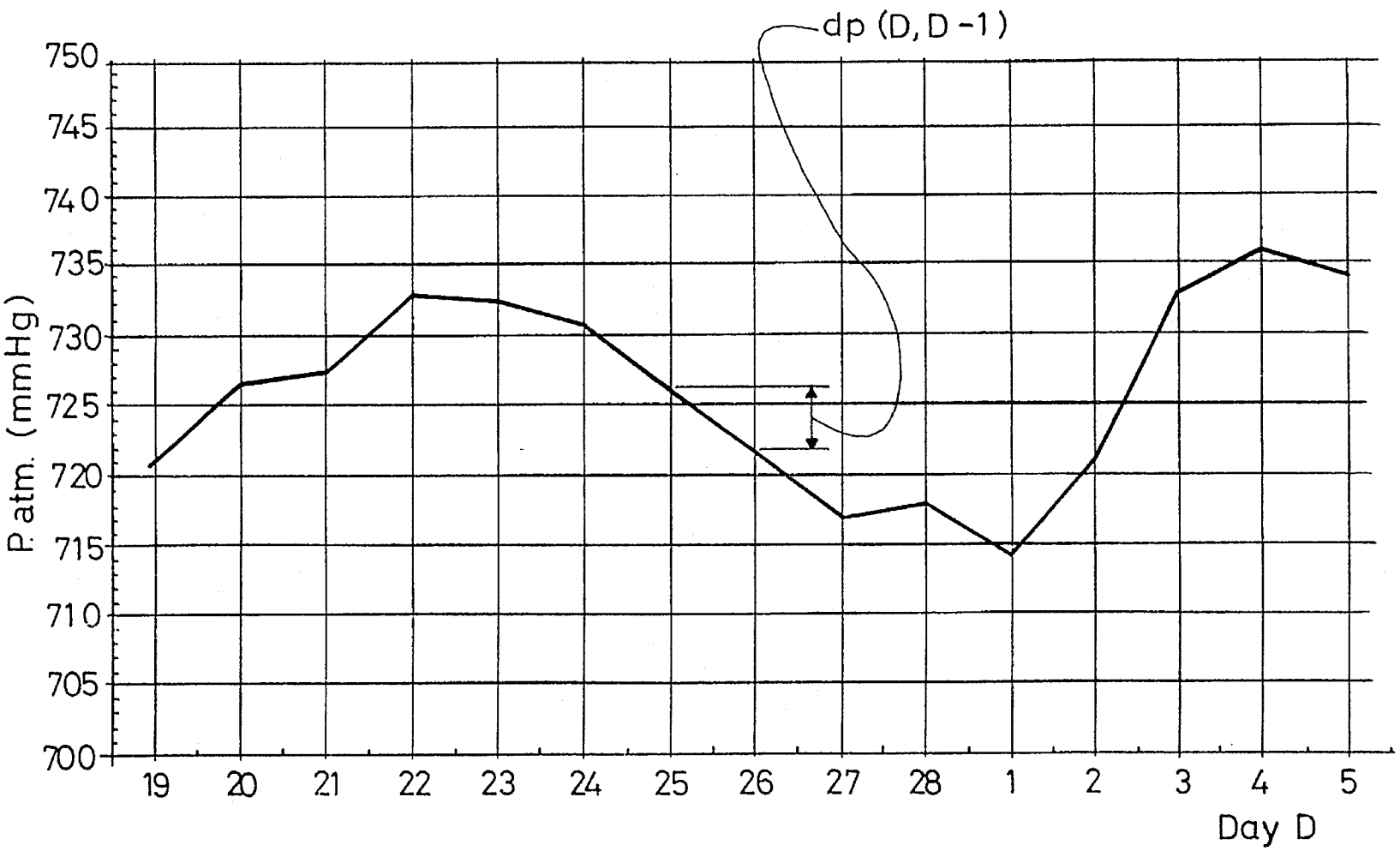
FIG. 4 is a graph depicting an example of a barometric measure over a period of two weeks.

FIG. 4 is an example of a result of a barometric measurement over a period of two weeks. As can be seen, the fluctuations of the atmospheric pressure which influence the weather are those which have a period more or less equal to twenty-four hours. This parameter is used in the watch according to the invention to measure the barometric tendency: this being determined by comparison, executed over a time interval large enough to allow a correct measurement, here this interval being twenty-four hours. $\Delta Pd,d-1$ which is the difference between the atmospheric pressure between two consecutive measurements, respectively on day "d" and on day "d–1", is measured and recorded. In this way, an automatic cycle of measurements may be executed, once every twenty-four hours. This measurement should be executed preferably during the night, for example at 2.00 am, to ensure more stable measurement conditions.

Of course, the wearer himself may execute a measurement, for example by pushing crown 4. Under certain conditions, a measurement having an interval less than 24 hours, for example 6 hours, is also possible. This is so as to give the wearer more direct information. However, in such a case, the minimum time interval between two measurements should be fixed (for example 3 to 4 hours), without which there might be a risk of interference between the two measurements and thus an unreliable result.

What is claimed is:

1. An analogue timepiece for indicating an atmospheric pressure variation comprising:

at least two hands (2, 3) for providing time information, a watch movement (12) for driving said hands, said watch movement including an electronic control means for controlling the watch movement for driving said hands, conversion means (30) electrically connected to said electronic control means, and a pressure sensor (13, 13*a*) for measuring the atmospheric pressure variation and providing to said conversion means indications of said atmospheric pressure variation, wherein one of the hands (2, 3) is driven by the movement (12) to indicate said measured pressure variation in response to pressure information provided by said conversion means to said electronic control means, while at the same time another one of said hands (3, 2) is driven by the movement to indicate a weather forecast which is a function of said measured variation and which is determined by said electronic control means.

2. Timepiece according to claim 1, further comprising a movable bezel (7) mounted on a middle of said watch and on which weather forecast indications are displayed, said bezel (7) being turnable to correct the forecast indication.

3. Timepiece according to claim 1, wherein the position of said hand (3) indicating the forecast may be adjusted to correct said forecast indication.

4. Timepiece according to claim 1, wherein said sensor (13, 13*a*) is a quartz sensor.

5. Timepiece according to claim 1, wherein said sensor is a capacitive sensor.

6. Timepiece according to claim 1, wherein said sensor is a piezo-resistive sensor.

7. Timepiece according to claim 1, further comprising a first internal back cover (16) comprising the sensor and a second external pierced back cover (18) to allow the to be measured surrounding air to pass therethrough.

* * * * *